US006109279A

United States Patent [19]

Kloss et al.

[11] Patent Number: 6,109,279

[45] Date of Patent: Aug. 29, 2000

[54] LOCKING DEVICE FOR AN UMBRELLA AND METHOD OF USE

[76] Inventors: Robert P. Kloss, 343 Clark Ave., Pomona, Calif. 91767; Joseph H. Bossler, 78625 Vista del Sol, Indian Wells, Calif. 92210

[21] Appl. No.: 09/224,174

[22] Filed: Dec. 31, 1998

[51] Int. Cl.[7] ..... A45B 3/00

[52] U.S. Cl. ..... 135/16; 70/58

[58] Field of Search ..... 135/15, 16.1; 108/50; 403/24, 196; 70/3, 6, 19, 51, 58, 59, 62

[56] References Cited

U.S. PATENT DOCUMENTS

| | | | |
|---|---|---|---|
| 1,856,000 | 4/1932 | Smith | 70/58 |
| 2,743,146 | 4/1956 | Wheeler | 135/16 |
| 4,353,659 | 10/1982 | Comte | 403/24 |
| 5,431,364 | 7/1995 | Etter | 135/16 |
| 5,535,978 | 7/1996 | Rodriguez | 135/16 |
| 5,713,225 | 2/1998 | Smith | 70/51 |
| 5,913,907 | 6/1999 | Leg | 70/58 |
| 6,038,891 | 3/2000 | Zeren | 70/58 |

*Primary Examiner*—Beth A. Stephan

*Attorney, Agent, or Firm*—Timothy Thut Tyson; Ted Masters; Freilich, Hornbaker & Rosen

[57] ABSTRACT

A locking device (20) for locking an umbrella (503) to a table includes an umbrella pole-receiving sleeve (22) having a first hole (24), a pin-receiving sleeve (28) perpendicularly connected to the umbrella pole-receiving sleeve (22) so that pin-receiving sleeve (28) is axially aligned with first hole (24). The pin-receiving sleeve (28) has two contrapositioned holes (32 and (34) which are sized to receive the shackle of a conventional lock (500). A pin (36) is slidably received by pin-receiving sleeve (28) and the first hole (24). Locking device (20) is placed around the pole (502) of the umbrella (503) in a location below the table top (506). Pin 36 is aligned with and inserted into a thruhole (504) in pole (502). A conventional lock (500) is then used to hold pin (36) in place within thruhole (504) thereby locking locking device (20) around the pole (502). Since locking device (20) is larger than the pole-receiving hole in table top (506), umbrella (503) cannot be removed from the table.

10 Claims, 7 Drawing Sheets

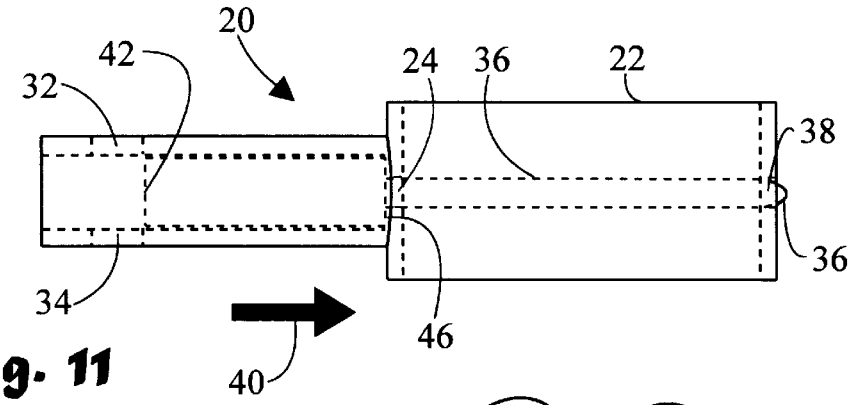
Fig. 11
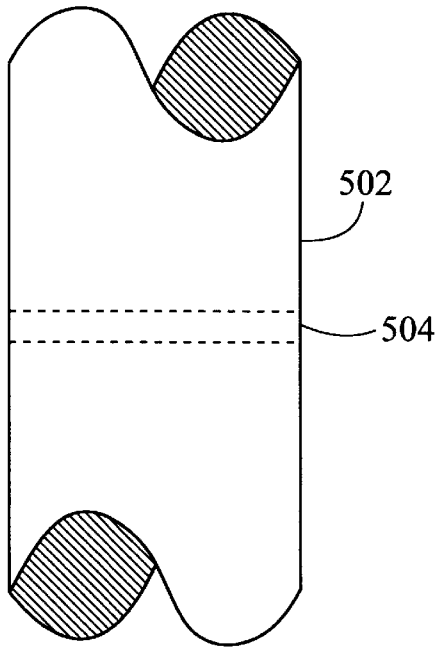
Fig. 12
Fig. 13
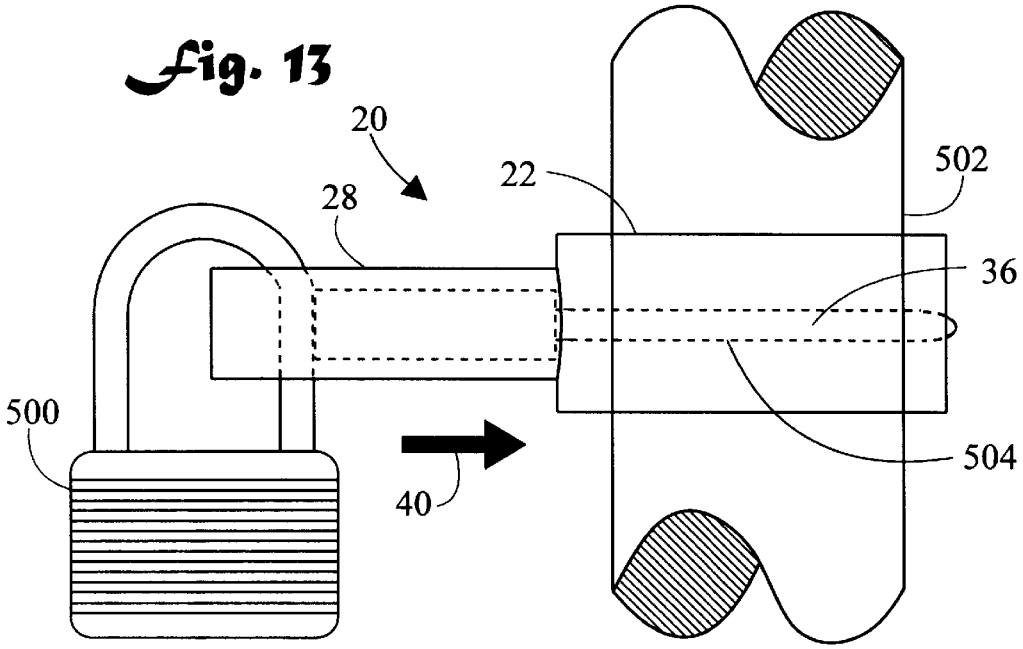

LOCKING DEVICE FOR AN UMBRELLA AND METHOD OF USE

TECHNICAL FIELD

The present invention pertains generally to umbrellas, and in particular to a device which locks the pole of a table-covering umbrella to the table so as to prevent theft of the umbrella.

BACKGROUND ART

Devices for locking or otherwise engaging umbrellas to tables are known in the art. For example, U.S. Pat. No. 2,743,146 illustrates an umbrella retainer for an elongated rectangular table using the pole of the umbrella passing through the table as one leg. A sleeve slides over the pole of the umbrella underneath the table surface and is held in place on the pole by a clamp screw. The other end of the table is held up by two folding legs. And, U.S. Pat. No. 4,353,659 discloses an umbrella locking sleeve in the center of a round table. A screw presses against the post of the umbrella to lock the sleeve in position in the center hole of the table. In a related technology, U.S. Pat. No. 1,856,000 shows a holder for a tree, bush, or flag staff having a sleeve which surrounds the trunk or staff, a pin which impales the trunk or staff, and a padlock which secures the pin in place to prevent surreptitious taking of the article.

Regarding the present invention, outdoor picnic-type tables having holes in their tops to receive an umbrella have been known for years and are generally inexpensive. A typical configuration would consist of a circular dining table with a centrally installed umbrella which provides shade for diners. With the advent of interior smoking bans at business establishments, restaurants, and the like, expensive tables with center holes for use with expensive table umbrellas have evolved. A typical table can cost $1,000 and a typical umbrella can cost $500. More elaborate models are available at double these costs. Expensive metal umbrellas that look like conventional table umbrellas have also been developed.

Theft of these expensive umbrellas has become a major problem. It is toward the solution of this theft problem that the locking device of present invention is directed.

DISCLOSURE OF INVENTION

The present invention is directed to a locking device which prevents an umbrella from being removed from the table into which it is inserted. The locking device attaches to the pole of the umbrella below the table top, and since the device is larger than the pole-receiving hole in the table top, the device prevents the pole of the umbrella from being upwardly removed from the table. A pin in the locking device is inserted into a diameter thruhole in the pole of the umbrella. A conventional lock such as a padlock is used to hold the pin in place thereby locking the locking device to the pole.

In accordance with a preferred embodiment of the invention, a locking device for locking an umbrella to a table includes an umbrella pole-receiving sleeve having a first hole. A pin-receiving sleeve is perpendicularly connected to the umbrella pole-receiving sleeve so that the pin-receiving sleeve is axially aligned with the first hole. The pin-receiving sleeve has two contrapositioned holes sized to accept a conventional lock. A pin is slidably received by the pin-receiving sleeve and the first hole.

In accordance with an important aspect of the invention, the umbrella pole-receiving sleeve has a second hole contrapositioned from the first hole, and the pin is slidably received by both the first hole and the second hole, thereby traversing the entire diameter thruhole of the pole of the umbrella.

In accordance with an important feature of the invention, the umbrella pole-receiving sleeve, the pin-receiving sleeve, and the pin are substantially cylindrical in shape.

In accordance with another important aspect of the invention, the pin further includes a shoulder which is larger than the first hole, so that when the pin is slid within the pin-receiving sleeve toward the umbrella pole-receiving sleeve, the shoulder engages the first hole and is stopped thereby.

In accordance with another important feature of the invention, the two contrapositioned holes in the pin-receiving sleeve are sized to receive a conventional lock, so that when the pin is fully slid toward the pole-receiving sleeve, the pin is held within the pin-receiving sleeve.

In accordance with another aspect of the invention, the umbrella has a pole which has a diameter thruhole. The pin is slidably received by the diameter thruhole.

In accordance with another feature of the invention, the pin includes an outward end which has either threads or a threaded hole.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 11 is a side elevation view of the pin fully inserted into the pin-receiving sleeve;

FIG. 12 is a side elevation view of an umbrella pole having a diameter thruhole;

FIG. 13 is a side elevation view of the present invention engaging the diameter thruhole of the umbrella pole;

MODES FOR CARRYING OUT THE INVENTION

Figure 1:
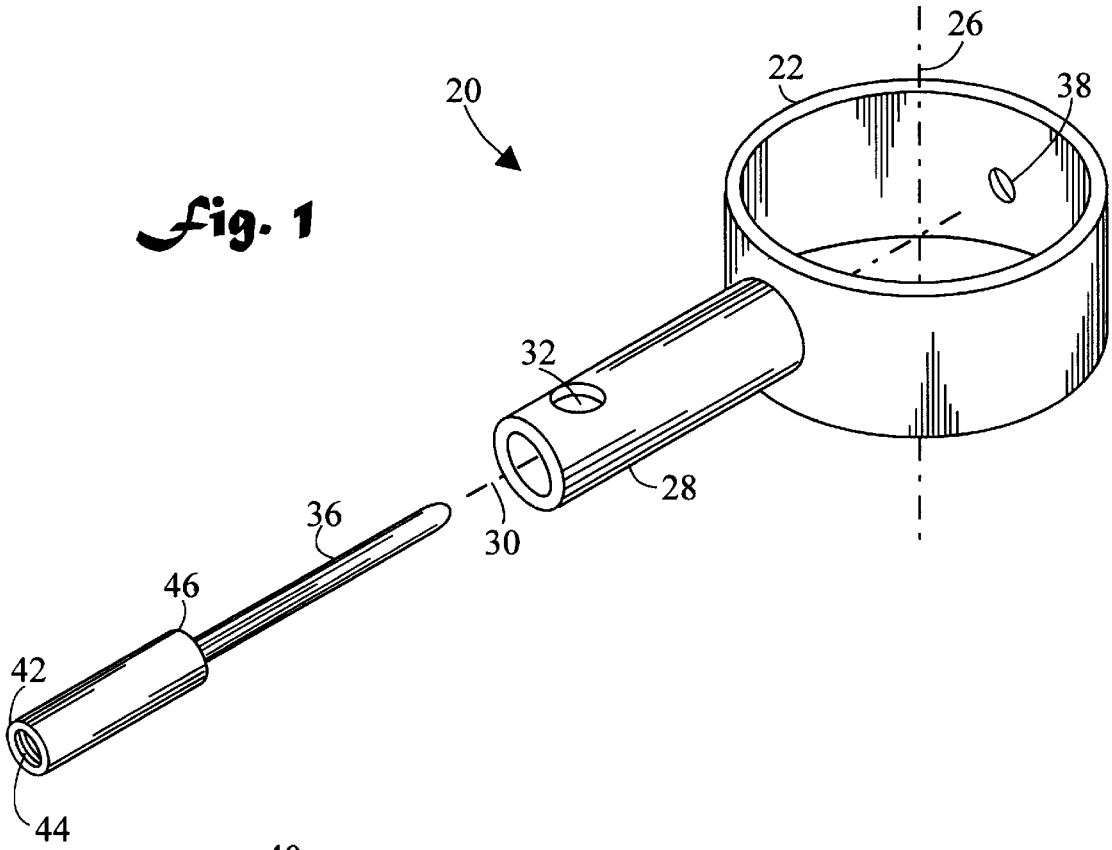
FIG. 1 is a perspective view of a locking device in accordance with the present invention.
Figure 2:
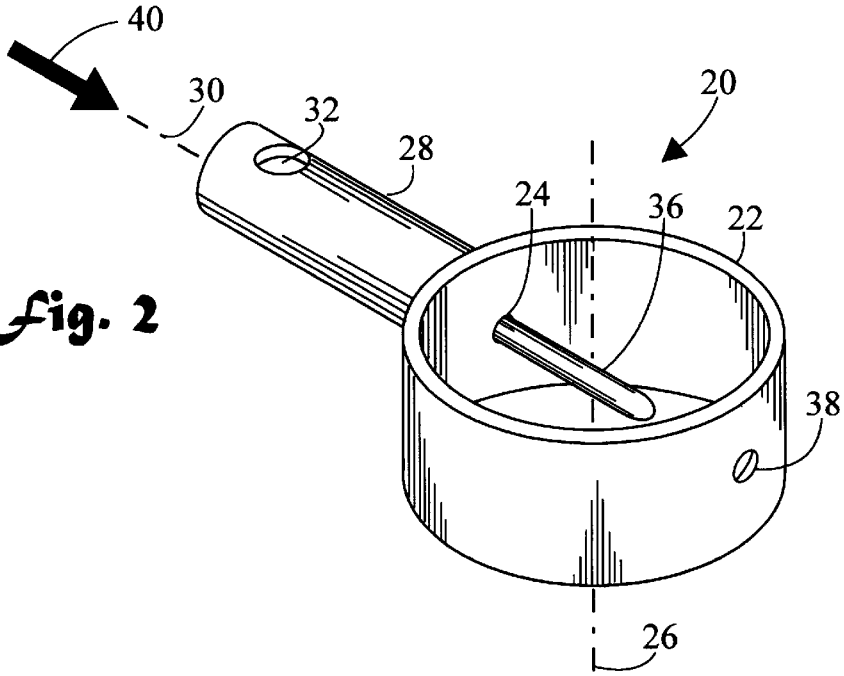
FIG. 2 is a reverse perspective view.

Referring initially to FIGS. 1 and 2, there are illustrated perspective and reverse perspective views respectively of a locking device for an umbrella, generally designated as 20. Locking device 20 includes an umbrella pole-receiving sleeve 22 having a first hole 24 on the side of sleeve 22. Pole-receiving sleeve 22 has a first central axis 26, and in a preferred embodiment is substantially cylindrical. A pin-receiving sleeve 28 is perpendicularly connected to pole-receiving sleeve 22 so that pin-receiving sleeve 28 is axially aligned with first hole 24. Pin-receiving sleeve 28, which in a preferred embodiment is substantially cylindrical, has a second central axis 30 which is substantially perpendicular to first axis 26, and in a preferred embodiment is substantially cylindrical. First hole 24 lies along second axis 30. Pin-receiving sleeve 28 also has two contrapositioned holes 32 and 34 (also refer to FIG. 4) which are sized to receive the shackle of a conventional lock 500 such as a padlock or chain lock (also refer to FIG. 13). An elongated pin 36 is slidably received along second axis 30 by pin-receiving sleeve 28 and first hole 24. In FIG. 2 pin 36 has been slid in direction 40 past first hole 24 an into the central cavity of pole-receiving sleeve 22. In a preferred embodiment, pole-receiving sleeve 22 has a second hole 38 contrapositioned from first hole 24 and also lying along second axis 30 so that pin 36 is received by both first hole 24 and second hole 38. That is, pin 36 is slid into pin-receiving sleeve 28 along second axis 30 in direction 40, so that pin 36 traverses pole-receiving sleeve 22 and engages both first hole 24 and second hole 38. Referring also to FIGS. 12 and 13, when pole-receiving sleeve 22 is placed around the pole 502 of an umbrella 503 (also refer to FIGS. 14 and 15) having a diameter thruhole 504, pin 36 is slidably received by the diameter thruhole 504 and retains locking device 20 around pole 502. Pin 36 has been fully slid toward pole-receiving sleeve 28 in direction 40 so that conventional lock 500 holds pin 36 within pin-receiving sleeve 28.

Pin 36 has an outward end 42 which has either threads or a threaded hole 44. Threads or a threaded hole 44 can receive a threaded extraction tool, such as a bolt, which is useful in removing pin 36 from the diameter thruhole 504 of pole 502. Pin 36 further includes a shoulder 46 which is larger than first hole 24, so that when pin 36 is slid within pin-receiving sleeve 28 toward pole-receiving sleeve 22, shoulder 46 engages first hole 24 and is stopped thereby. That is, pin 36 is prevented from completely sliding through pole-receiving sleeve 28.

Figure 3:
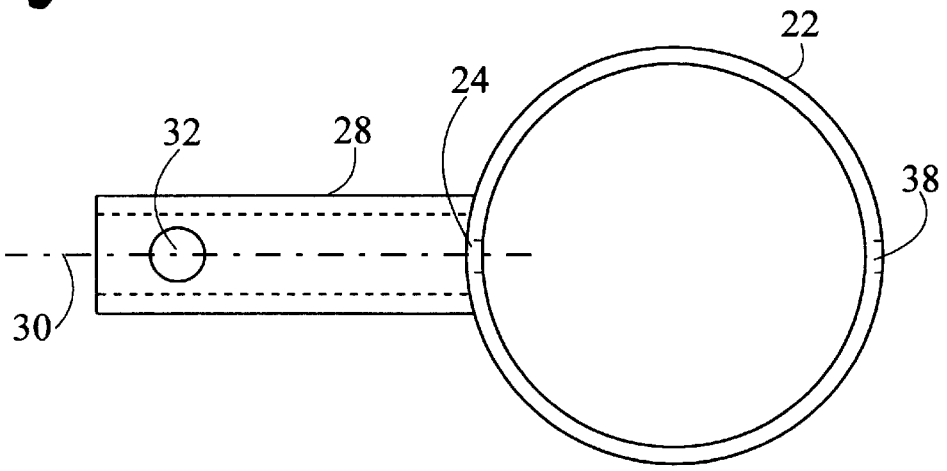
FIG. 3 is a top plan view of an umbrella pole-receiving sleeve connected to a pin-receiving sleeve.

FIG. 3 is a top plan view of umbrella pole-receiving sleeve 22 connected to a pin-receiving sleeve 28, showing first and second holes 24 and 38, one contrapositioned hole 32, and second axis 30.

Figure 4:
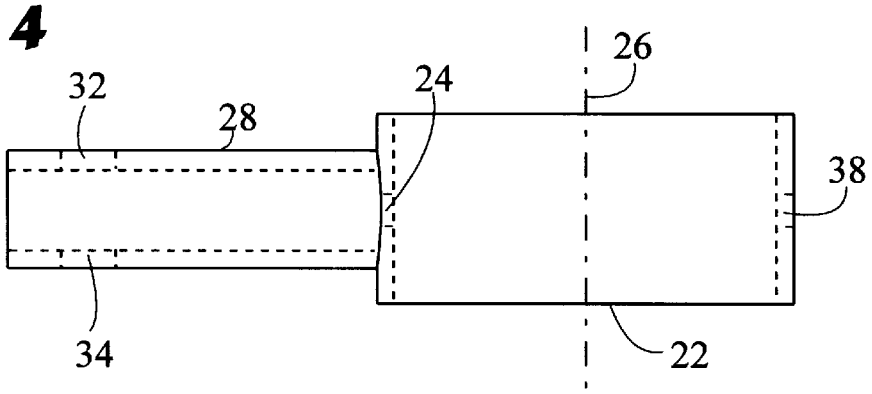
FIG. 4 is a side elevation view of FIG. 3.

FIG. 4 is a side elevation view of umbrella pole-receiving sleeve 22 and pin-receiving sleeve 28 showing contrapositioned holes 32 and 34, first and second holes 24 and 38, and first axis 26.

Figure 5:
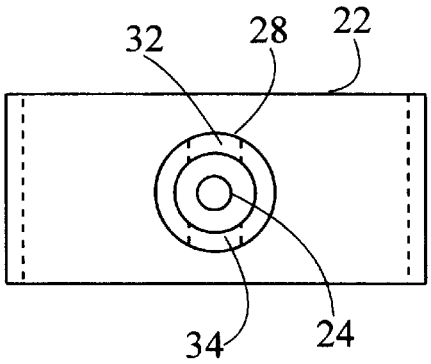
FIG. 5 is a first end elevation view of FIG. 3.

FIG. 5 is a first end elevation view of umbrella pole-receiving sleeve 22 and pin-receiving sleeve 28 showing first hole 24 and contrapositioned holes 32 and 34.

Figure 6:
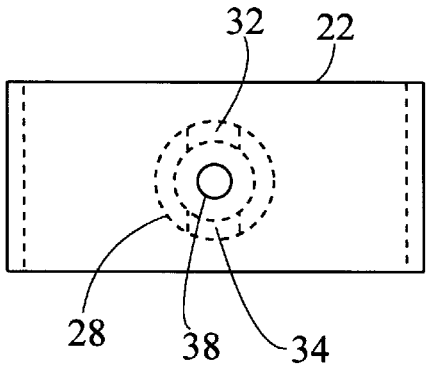
FIG. 6 is an opposite end elevation view of FIG. 3.

FIG. 6 is an opposite end elevation view of umbrella pole-receiving sleeve 22 and pin-receiving sleeve 28 showing second hole 38.

Figure 7:
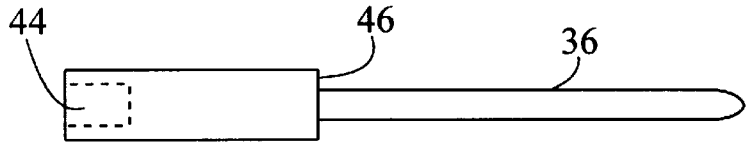
FIG. 7 is a side elevation view of a pin.

FIG. 7 is a side elevation view of a pin 36 showing shoulder 46 and threaded hole 44.

Figure 8:
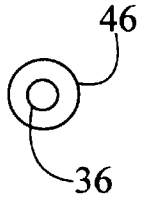
FIG. 8 is a first end elevation view of the pin.

FIG. 8 is a first end elevation view of pin 36 showing shoulder 46.

Figure 9:
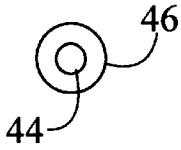
FIG. 9 is an opposite end elevation view of the pin.

FIG. 9 is an opposite end elevation view of pin 36 showing threaded hole 44.

Figure 10:
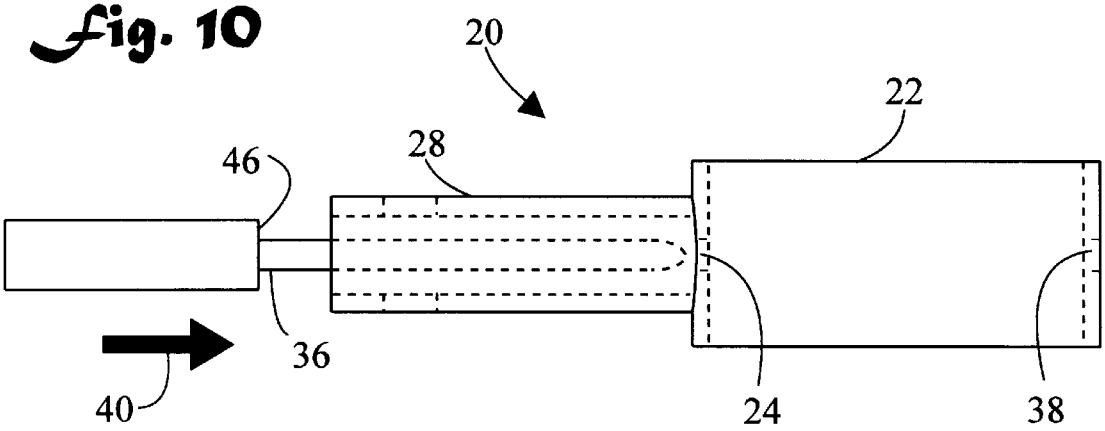
FIG. 10 is a side elevation view of the pin being inserted into a pin-receiving sleeve.

FIG. 10 is a side elevation view of pin 36 being inserted into a pin-receiving sleeve 28 in direction 40.

FIG. 11 is a side elevation view of pin 36 fully inserted into the pin-receiving sleeve 28 so that pin 36 completely passes through pole-receiving sleeve 22 and engages first hole 24 and second hole 38. It is noted that pin 36 has fully slid into pin-receiving sleeve 28 and outer end 42 of pin 36 has cleared contrapositioned holes 32 and 34 so that a conventional lock 500 can be used to hold pin 36 in place within pin-receiving sleeve 28.

FIG. 12 is a side elevation view of an umbrella pole 502 having a diameter thruhole 504.

FIG. 13 is a side elevation view of the locking device 20 engaging the umbrella pole 502. Pin 36 is inserted through diameter thruhole 504, and conventional lock 500 retains pin 36 in place so that locking device 20 cannot be removed from umbrella pole 502. In the shown embodiment, pin 36 passes completely through diameter thruhole 504.

Figure 14:
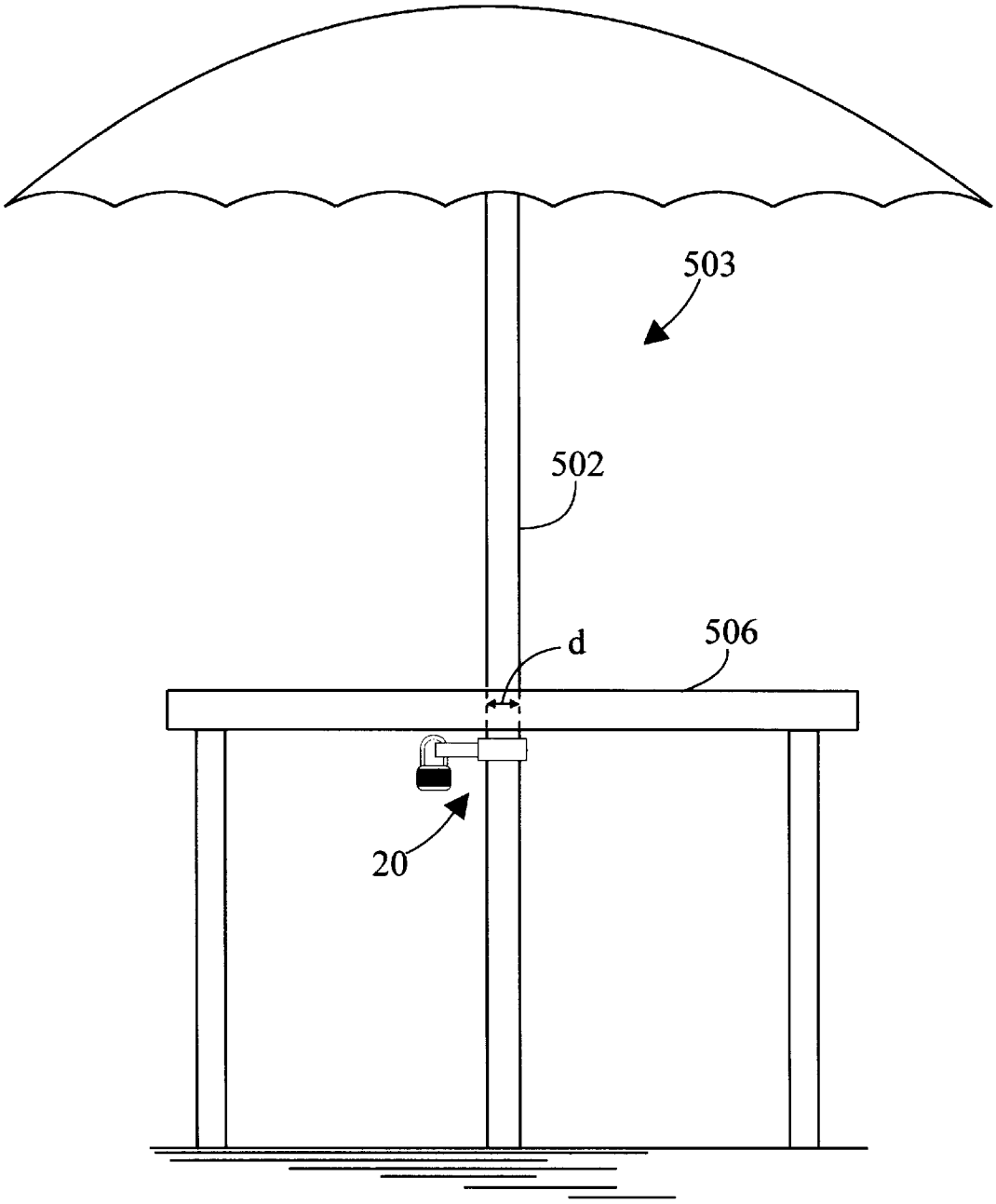
FIG. 14 is a reduced side elevation view of the present invention installed on an umbrella pole to lock the umbrella to a table.

FIG. 14 is a reduced side elevation view of locking device 20 installed on an umbrella pole 502 of an umbrella 503 to lock the umbrella 503 to a table top 506. Locking device 20 is place just below table top 506. Because locking device is larger than the diameter d of the pole-receiving hole in table top 506, the umbrella 503 cannot be upwardly removed from table 506, and theft is thereby prevented.

Figure 15:
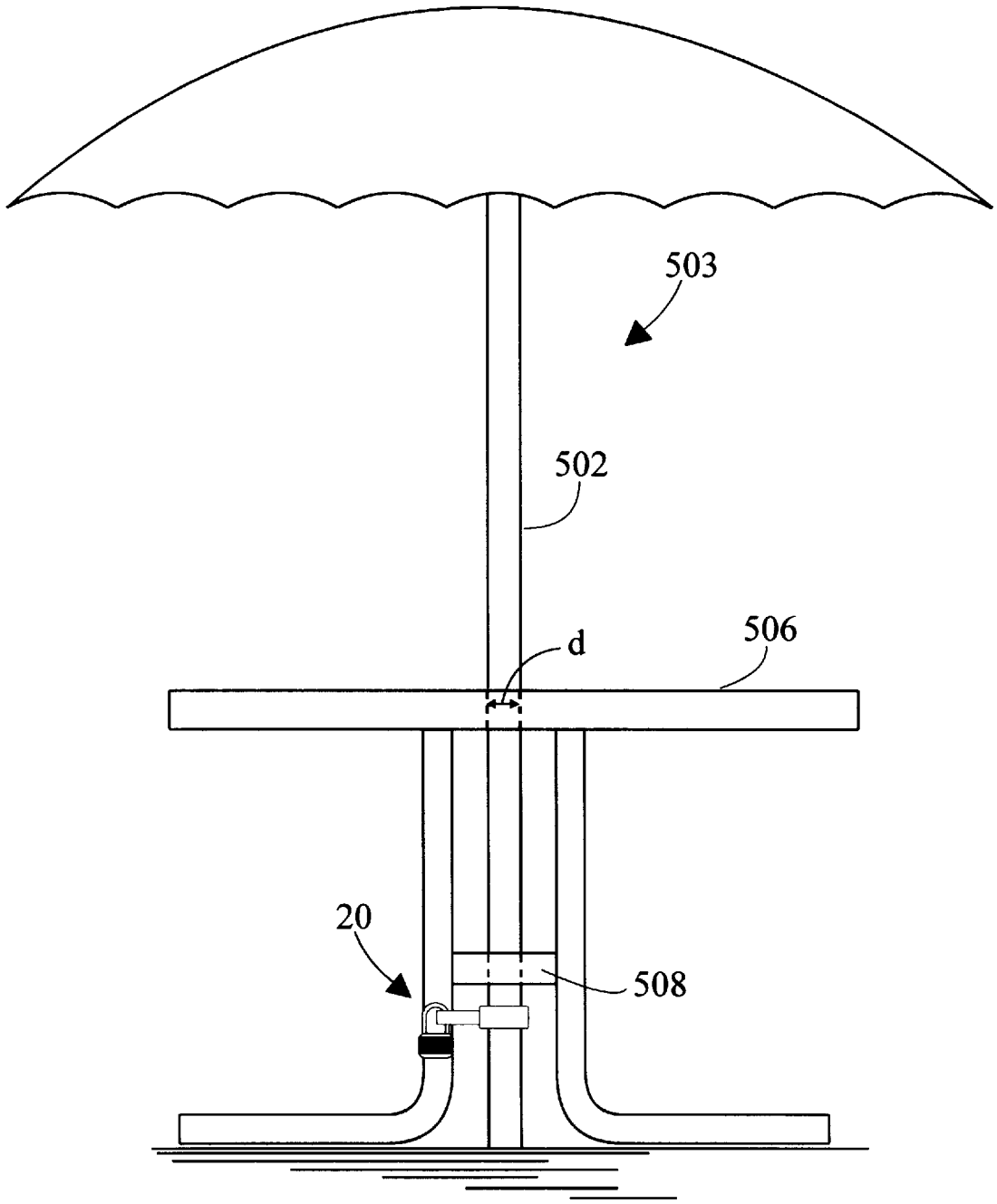
FIG. 15 is a reduced side elevation view of the present invention installed on an umbrella pole to lock the umbrella to a different type of table; and, FIG. 16 is a perspective view of a second embodiment.

FIG. 15 is a reduced side elevation view of locking device 20 installed on an umbrella pole 502 of an umbrella 503 to lock the umbrella 503 to a different type of table. Rather than placing locking device 20 just below table top 506, the locking device 20 is place below a support member 508 which also has pole-receiving hole of diameter d.

Locking device 20 is used as follows. Pole 502 of umbrella 503 is downwardly inserted into the pole-receiving hole so that the diameter thruhole 504 is below table top 506. Pole 502 is then inserted into pole-receiving sleeve 22, and pole-receiving sleeve 22 is moved up pole 502 and aligned with diameter thruhole 504. Pin 36 is then pushed into diameter thruhole 504 until it clears contrapositioned holes 32 and 34 in pin-receiving sleeve 28. A conventional lock 500 is then secured through contrapositioned holes 32 and 34.

In a preferred embodiment pole-receiving sleeve 22, pin-receiving sleeve 28, and pin 36 are all fabricated from stainless steel. Pole-receiving sleeve 22 and pin-receiving sleeve 28 are welded together.

Figure 16:
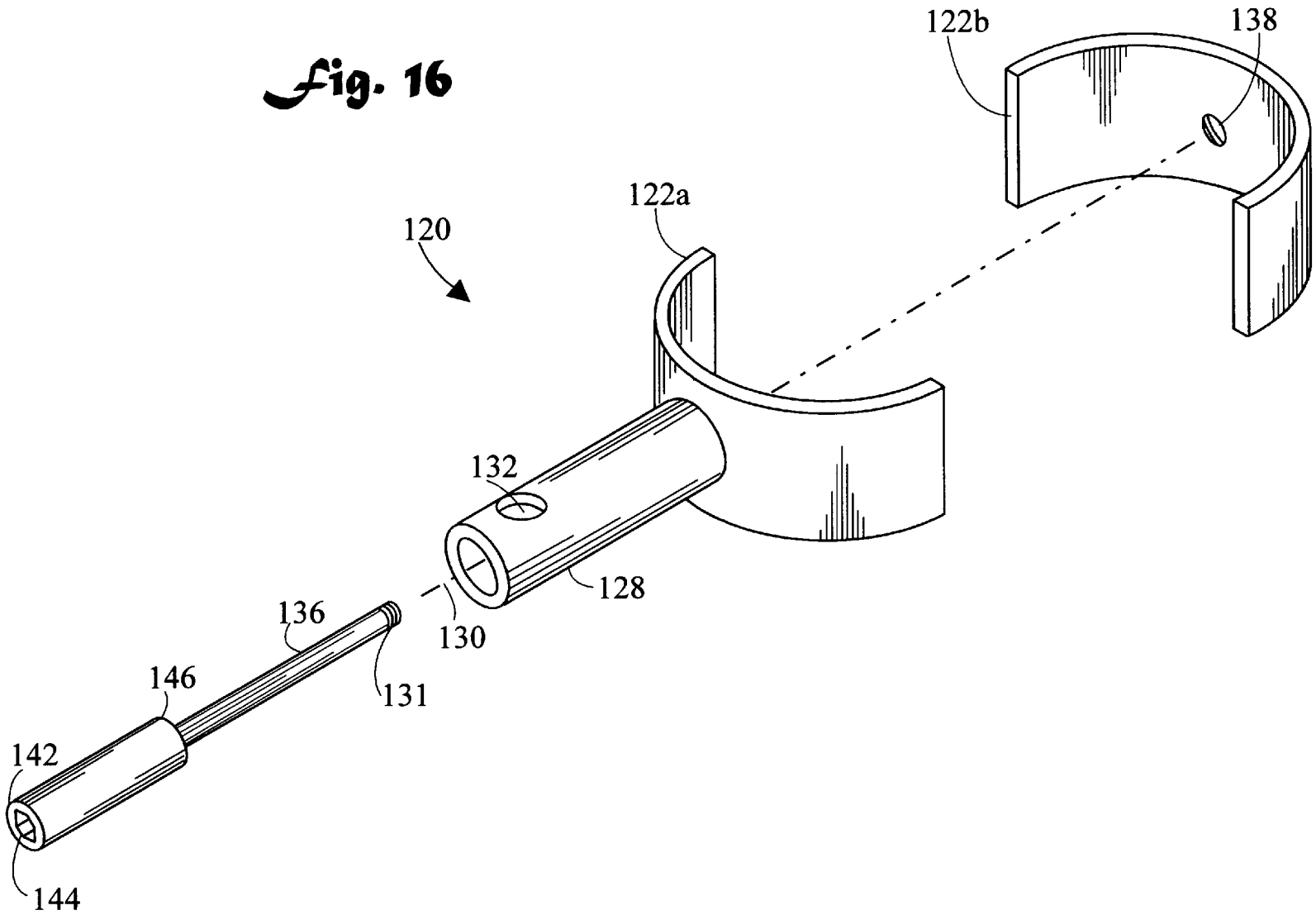

FIG. 16 is a perspective view of a second embodiment, generally designated as 120. In this embodiment, umbrella pole-receiving sleeve includes a first half-sleeve **122*a* which is connected to pin-receiving sleeve 128, and a second half-sleeve 122*b* having first hole 138. First hole 138 includes threads. Pin 136 has a threaded end 131 which is sized to cooperate with the threads of first hole 138. This embodiment is useful if for some reason the locking device 20 cannot be directly placed around pole 502 as the pole 502 is inserted into the table. End 142 of pin 136 has a cavity 144** shaped to accommodate an allen wrench.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A locking device for an umbrella, comprising:

an umbrella pole-receiving sleeve having a first hole;

a pin-receiving sleeve perpendicularly connected to said umbrella pole-receiving sleeve so that said pin-receiving sleeve is aligned with said first hole;

said pin-receiving sleeve having two contrapositioned holes; and, a pin slidably received by said pin-receiving sleeve and said first hole.

2. A locking device according to claim 1, further including:

said umbrella pole-receiving sleeve having a second hole contrapositioned from said first hole; and, said pin slidably received by said first hole and said second hole.

3. A locking device according to claim 1, wherein said umbrella pole-receiving sleeve, said pin-receiving sleeve, and said pin are substantially cylindrical.

4. A locking device according to claim 1, further including:

said pin further including a shoulder which is larger than said first hole;

so that when said pin is slid within said pin-receiving sleeve toward said umbrella pole-receiving sleeve, said shoulder engages said first hole and is stopped thereby.

5. A locking device according to claim 1, said locking device cooperating with a conventional lock, further including:

said two contrapositioned holes in said pin-receiving sleeve sized to receive the conventional lock; and, so that when said pin is fully slid toward said pole-receiving sleeve, said pin is held within said pin-receiving sleeve by the conventional lock.

6. A locking device according to claim 1, the umbrella having a pole having a diameter thruhole, said locking device further including:

said pin slidably received by the diameter thruhole.

7. A locking device according to claim 1, further including:

said pin including an outward end; and, said outward end having one of threads and a threaded hole.

8. A locking device according to claim 1, further including:

said umbrella pole-receiving sleeve having a second hole contrapositioned from said first hole;

said pin slidably received by said first hole and said second hole;

said umbrella pole-receiving sleeve, said pin-receiving sleeve, and said pin being substantially cylindrical;

said pin further including a shoulder which is larger than said first hole, so that when said pin is slid within said pin-receiving sleeve toward said umbrella pole receiving sleeve, said shoulder engages said first hole and stops said pin; and, said two contrapositioned holes in said pin-receiving sleeve sized to receive a conventional lock, so that when said pin is fully slid toward said pole-receiving sleeve, said pin can held within said pin-receiving sleeve by the conventional lock.

9. A locking device according to claim 1, further including:

said umbrella pole-receiving sleeve including a first half-sleeve connected to said pin-receiving sleeve, and a second half-sleeve having said first hole; and, said first hole including threads; and, said pin having a threaded end sized to cooperate with said threads of said first hole.

10. A method for locking an umbrella to an umbrella table, comprising;

providing a table having a table top having an umbrella pole-receiving hole;

providing an umbrella having a pole having a diameter thruhole;

providing a conventional lock;

providing a locking device for an umbrella, comprising an umbrella pole-receiving sleeve having a first hole, a pin-receiving sleeve perpendicularly connected to said umbrella pole-receiving sleeve so that said pin-receiving sleeve is aligned with said first hole, said pin-receiving sleeve having two contrapositioned holes, and, a pin slidably received by said pin-receiving sleeve and said first hole;

downwardly inserting said pole in said pole-receiving hole so that said diameter thruhole is below said table top;

inserting said pole into said umbrella pole receiving sleeve;

moving said locking device up said pole until said umbrella pole-receiving sleeve is aligned with said diameter thruhole;

pushing said pin into said diameter thruhole until said pin clears said contrapositioned holes in said pin-receiving sleeve; and, securing said conventional lock through said contrapositioned holes.

* * * * *